US007231955B1

(12) United States Patent
Bullied et al.

(10) Patent No.: US 7,231,955 B1
(45) Date of Patent: Jun. 19, 2007

(54) INVESTMENT CASTING MOLD DESIGN AND METHOD FOR INVESTMENT CASTING USING THE SAME

(75) Inventors: Steven J. Bullied, Pomfret Center, CT (US); P. Brennan Reilly, Boston, MA (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 11/343,370

(22) Filed: Jan. 30, 2006

(51) Int. Cl.
*B22C 9/04* (2006.01)

(52) U.S. Cl. ..... 164/35; 164/516; 164/361; 164/133

(58) Field of Classification Search ..... 164/34–36, 164/122.1, 122.2, 133–136, 516–519, 361
See application file for complete search history.

(56) References Cited

U.S. PATENT DOCUMENTS 5,244,187 A * 9/1993 Manginelli ..... 164/129

* cited by examiner

*Primary Examiner*—Kuang Y. Lin
(74) *Attorney, Agent, or Firm*—Bachman & LaPointe, P.C.

(57) ABSTRACT

A method for investment casting includes the steps of positioning a base plate relative to a die; molding a first material between the die and at least a first surface portion of the base plate; securing one or more patterns to the base plate, the one or more patterns comprising a second material; applying one or more coating layers over at least portions of the one or more patterns and at least a portion of the first material; substantially removing the first material through an interior receptacle of a manifold body and the second material through an exterior receptacle of the manifold body to leave one or more shells formed by the coating layers; removing said base plate; introducing molten metal to the one or more shells through the interior receptacle of the manifold body; permitting the molten metal to solidify; and destructively removing one or more investment casting molds.

9 Claims, 3 Drawing Sheets

INVESTMENT CASTING MOLD DESIGN AND METHOD FOR INVESTMENT CASTING USING THE SAME

FIELD OF USE

The present disclosure relates to mold designs and, more particularly, to investment casting mold designs.

BACKGROUND OF THE INVENTION

Investment casting is a commonly used technique for forming metallic components having complex geometries, especially hollow components, and is used in the fabrication of superalloy gas turbine engine components.

A well developed field exists regarding the investment casting of turbine engine parts such as blades and vanes. In an exemplary process, a mold is prepared having one or more mold cavities, each having a shape generally corresponding to the part to be cast. An exemplary process for preparing the mold involves the use of one or more wax patterns of the part. The patterns are formed by molding wax over ceramic cores generally corresponding to positives of the cooling passages within the parts. The patterns are mounted to a shelling fixture. Prior to mounting, the fixture may be prepared to receive the patterns. For example, the fixture may be dipped in wax to at least coat a base plate of the fixture. The wax patterns may be placed atop the wax coating on the base plate and wax welded thereto.

In a shelling process, a ceramic shell is formed around one or more such patterns such as by spraying and/or dipping a ceramic coating material over the fixtured patterns. The wax may be removed such as by melting in an autoclave. The shell may be further processed such as by trimming and sanding of a base surface to flatten the base surface. The shell may be fired to harden the shell. This leaves a mold comprising the shell having one or more part-defining compartments which, in turn, contain the ceramic core(s) defining the cooling passages. The shell may be seeded to define the crystal orientation of the ultimate part and placed with its base surface atop a chill plate in a casting furnace. Molten alloy may then be introduced to the mold to cast the part(s). Upon cooling and solidifying of the alloy, the shell and core may be mechanically and/or chemically removed from the molded part(s). The part(s) can then be machined and treated in one or more stages.

Typically, there are two prevailing investment casting mold design philosophies in the prior art. The first design has a mold dipped in a cage, with a top and bottom plate. The cage is completely immersed in the shell build process. The ceramic top plate is then trimmed with a diamond wheel prior to casting in order to maintain a tight baffle fit necessary in the DS casting process. This mold design has its advantages. For instance, the mold permits bottom feeding with ease and facilitates proper venting. The bottom feeding practice limits the erosion experienced by the ceramic shell and also washes away any debris through the part cavity while filling takes place. However, the trimming process liberates a large amount of ceramic dust. This ceramic dust poses a hazard as the dust could become lodged within the molds and trapped in the thin features being produced in the molded part, thus causing part variations.

The second design utilizes a prefabricated pour cup and only a bottom plate. The mold is only dipped until the ceramic slurry overlaps the existing pour cup. This mold design also exhibits advantages. For instance, the design does not employ a top ceramic plate so the trimming step, mentioned above, is eliminated which in turn generates less ceramic debris. In addition, the absence of the top ceramic plate also creates a repeatable top profile of the mold for a consistent baffle fit. However, the mold design does not permit bottom feeding the part cavity and also fails to leave a passage for wax to evacuate during the venting or dewax process.

Consequently, there exists a need for an investment casting mold design that eliminates the trimming step and limits the amount of debris generated.

There also exists a need for an investment casting mold design that provides a route for the wax to exit during the dewax process.

SUMMARY OF THE INVENTION

In accordance with the present disclosure, a method for investment casting broadly comprises positioning a base plate relative to a die; molding a first material between the die and at least a first surface portion of the base plate; securing one or more patterns to the base plate, the one or more patterns comprising a second material; applying one or more coating layers over at least portions of the one or more patterns and at least a portion of the first material; substantially removing the first material through an interior receptacle of a manifold body and the second material through an exterior receptacle of the manifold body to leave one or more shells formed by the coating layers; removing said base plate; introducing molten metal to the one or more shells through the interior receptacle of the manifold body; permitting the molten metal to solidify; and destructively removing one or more investment casting molds.

In accordance with the present disclosure, a mold assembly broadly comprises a plurality of mold sections; and a manifold body having a dual wall pour chamber broadly comprising the interior receptacle comprising a first substantially conical shaped wall having an interior surface and an exterior surface, the exterior receptacle comprising a second substantially conical shaped wall circumferentially disposed about the interior receptacle and having an interior surface and an exterior surface, wherein the interior surface of the interior receptacle defines in part an aperture, and the exterior surface of the interior receptacle and the interior surface of the exterior receptacle define in part the substantially circular channel; a plurality of feeder conduits, each extending from the dual wall pour chamber toward an associated one or more of the plurality of mold sections; and a plurality of vents, each extending from the plurality of mold sections toward the dual wall pour chamber.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

The investment casting mold design and method for investment casting using the same described herein combines the advantages of both prior art designs. The investment casting mold design utilizes a manifold body equipped with a dual wall pour cup and a single baseplate which eliminates the need for trimming the top plate and provides a route for wax material to exit during the dewax process. In addition, the mold can be shelled and prepped for casting in a shorter period of time, which limits the amount of shell which must be trimmed away from the pour cup and the amount of debris that could potentially enter the mold.

Figure 2:
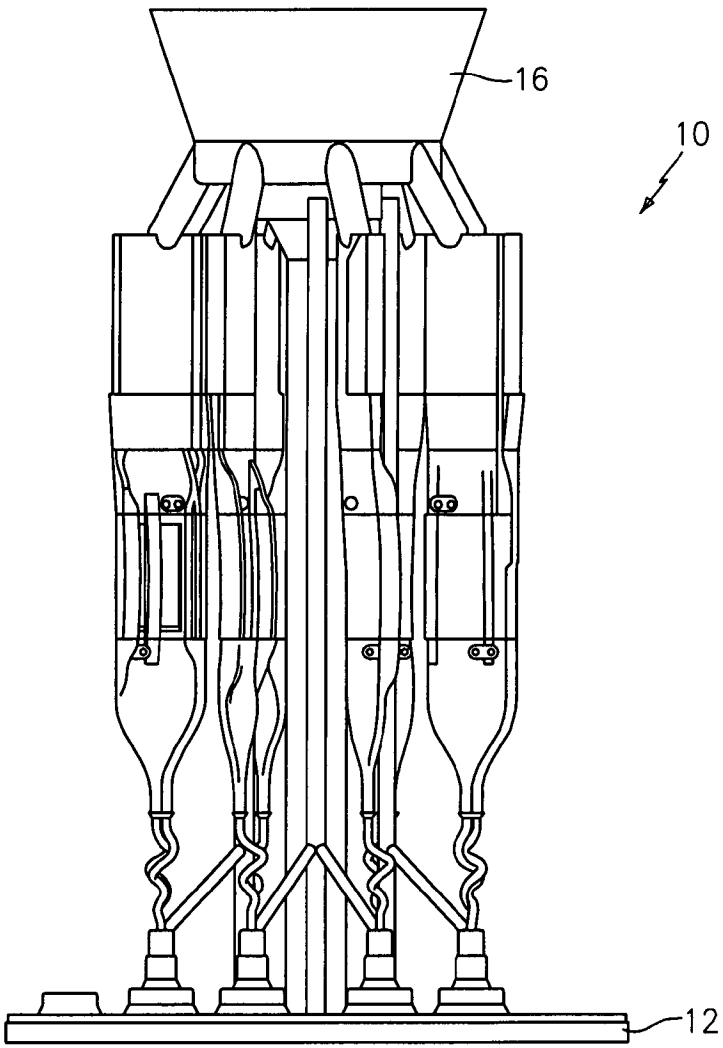
FIG. 2 is a representation of a side view of the investment casting mold design of FIG. 1.
Figure 1:
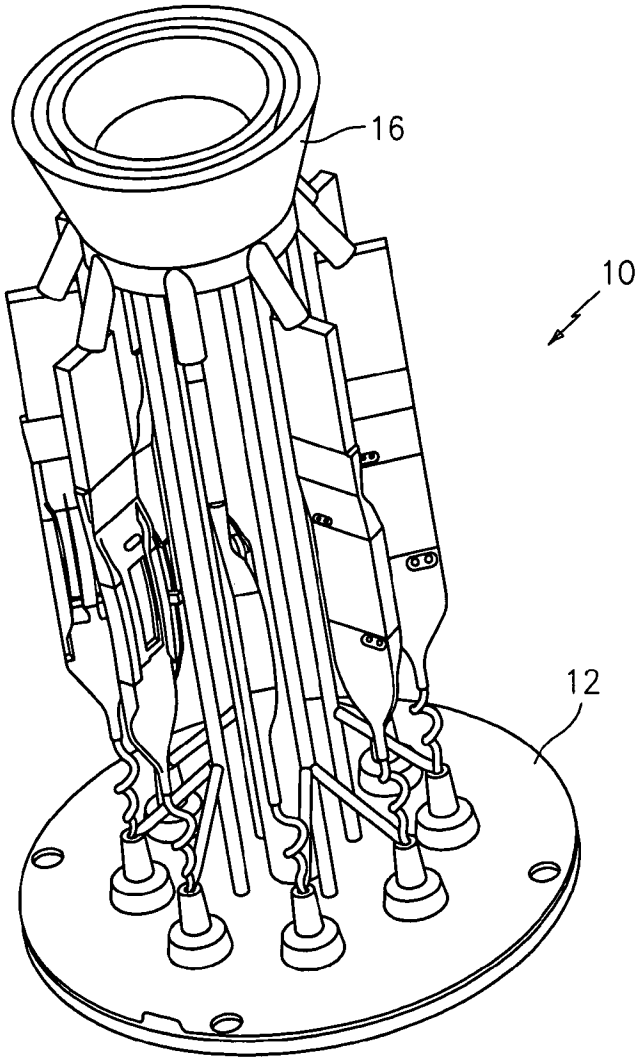
FIG. 1 is a representation of a perspective view of an investment casting mold design of the present disclosure.

Referring generally now to FIGS. 1–2, the investment casting mold design of the present disclosure is shown. An investment casting mold design 10 may generally comprise a baseplate 12 that supports a sprue 14 upon which a manifold body 16 is mounted. One or more feeder conduits 18 may be connected to the sprue 14. Each feeder conduit 18 may be in communication with the manifold body 16 at a first end 17 and in communication with a gate 20 at a second end 19. One or more patterns 22, each disposed within a base 24 connected to the gate 20. Each pattern 22 may be mounted within the investment casting mold design 10 to receive a quantity of molten metal sufficient to ultimately create an investment casting mold of a turbine engine component.

The manifold body 16 may generally comprise a dual wall pour chamber 26. The dual wall design provides several advantages for performing the investment casting process and enhancing the quality of the finished product. The dual wall pour chamber 26 may comprise an interior receptacle 28 comprising a first substantially conical shaped wall having an interior surface and an exterior surface, and an exterior receptacle 30 comprising a second substantially conical shaped wall having an interior surface and an exterior surface. The exterior receptacle 30 may be circumferentially disposed about the interior receptacle 28. The interior surface of the interior receptacle 28 defines in part an aperture 32 which is in fluid communication with one or more feeding conduits 18. The exterior surface of the interior receptacle 28 and the interior surface of the exterior receptacle 30 combine to define in part a substantially circular channel 34 which is in fluid communication with one or more vents 36 of the manifold body 16. Each vent 36 is also in fluid communication with each respective pattern 22 at an end opposite the manifold body 16.

Figure 3:
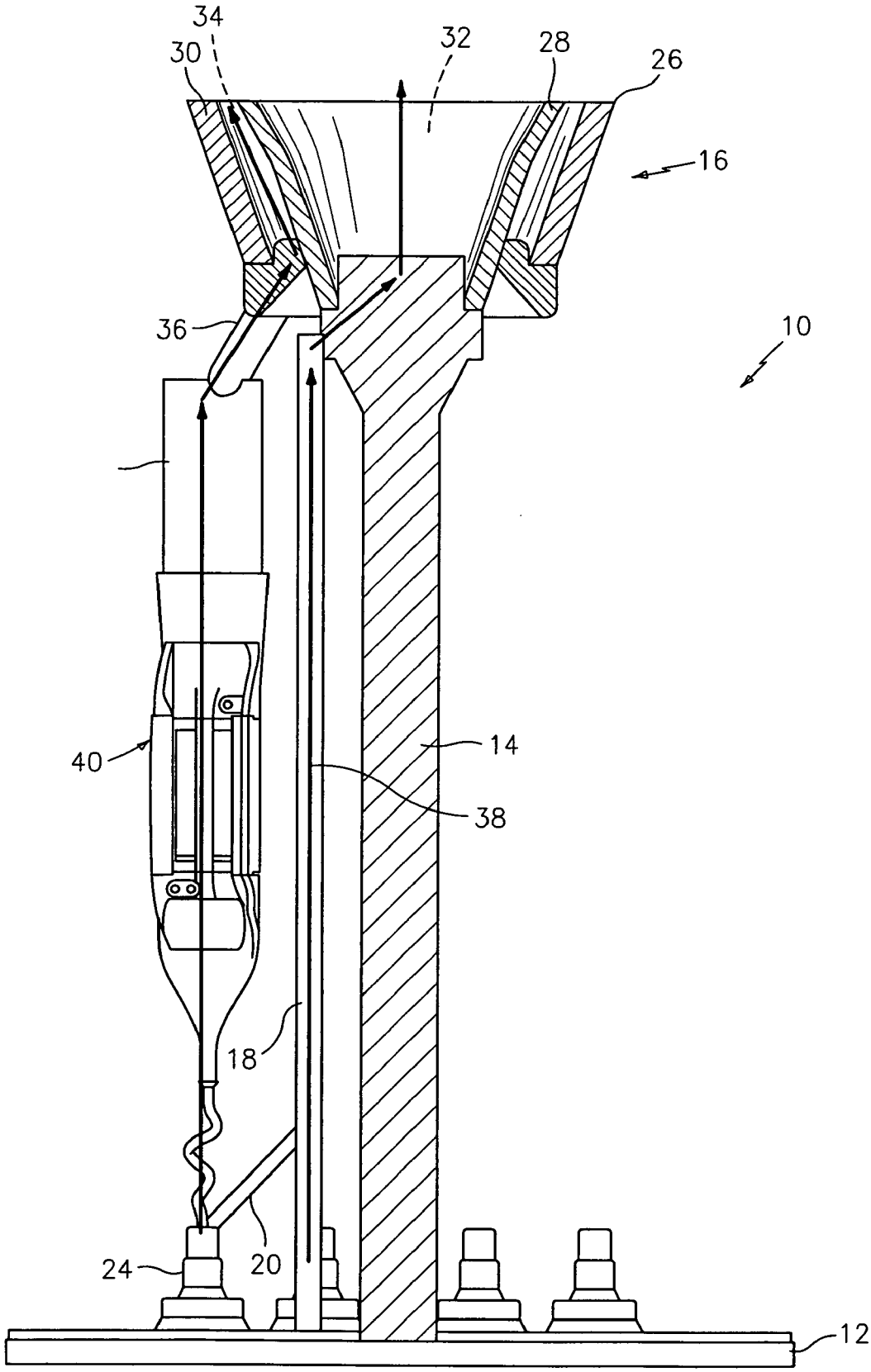
FIG. 3 is a representation of a cross-sectional view of the investment casting mold design of FIG. 1 illustrating the flow of wax during the dewax process.

Referring now to FIG. 3, once shelling is completed, the dewaxing or venting process may take place. During the dewax process, one or more wax materials from the baseplate 12 and pattern 22 accumulated prior to the shelling process are removed by any number of methods known to one of ordinary skill in the art. In accordance with the design advantages of the mold described herein, the wax material from the baseplate 12 may be melted, for example, and substantially liquefied to permit the wax to flow through the feeder conduit 18 in a direction indicated by an arrow 38. The liquefied wax material flows through the feeder conduit 18 and aperture 32 to collect within the interior receptacle 28 of the dual wall pour cup 26. Simultaneously, the wax material from the pattern 22 may be melted, for example, and again substantially liquefied to permit the wax to flow through the vent 36 and substantially circular channel 34 to collect within the exterior receptacle 30. The manifold body 16 may be disassembled from the mold 10 and the wax material removed from both the interior receptacle 26 and the exterior receptacle 28.

Figure 4:
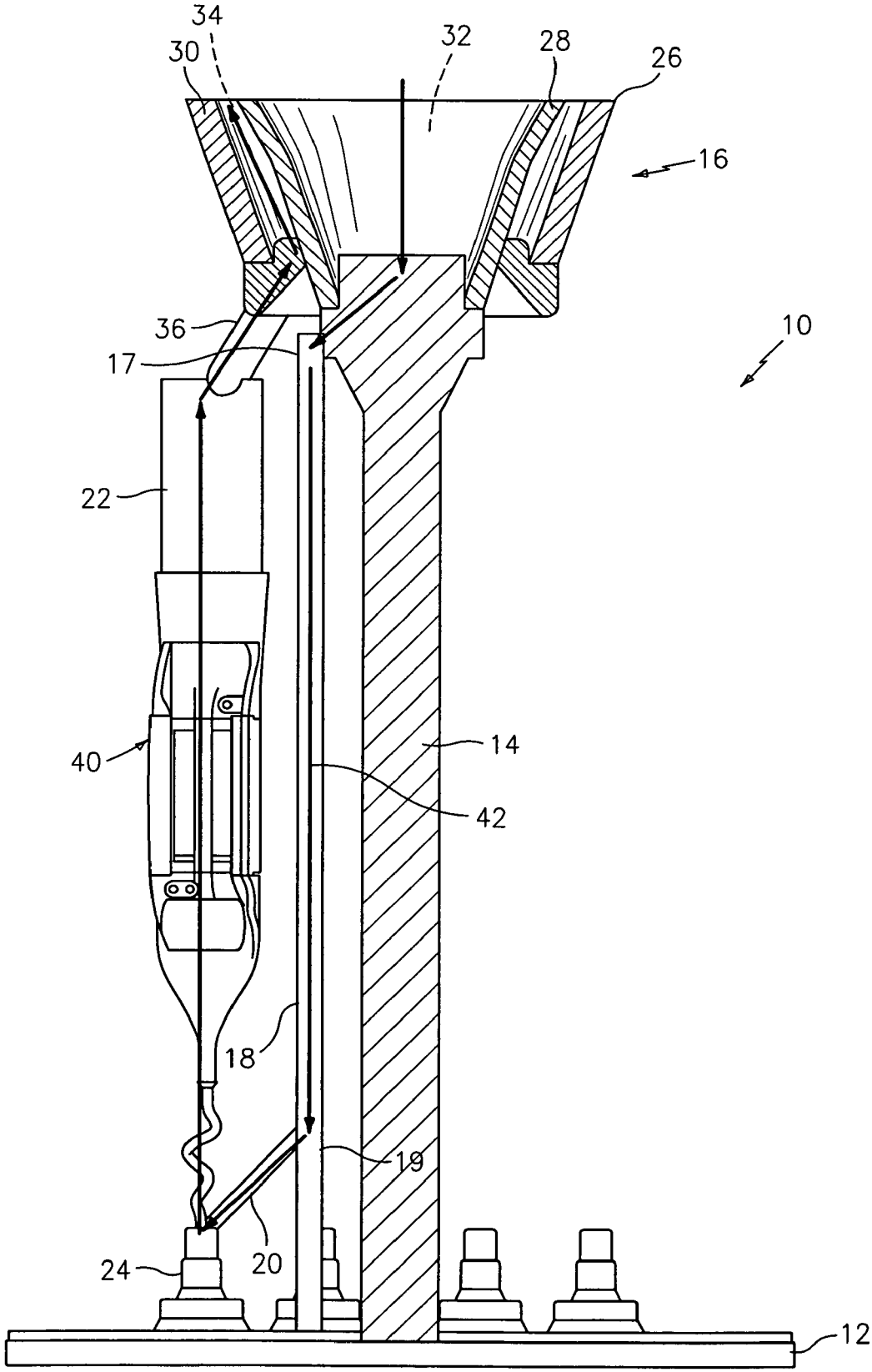
FIG. 4 is a representation of another cross-sectional view of the investment casting mold design of FIG. 1 illustrating the flow of metal during the casting process.

Referring now to FIG. 4, once dewax is complete, a shell 40 created during the shelling process may be trimmed, sanded and fired in accordance with typical investment casting procedures as known to one of ordinary skill in the art. A quantity of molten material may then be introduced into the shell 40 via the manifold body 16 of the investment casting mold design 10. More particularly, the molten material may be introduced into the interior receptacle 26 and flow through each feeder conduit 18 in a direction indicated by an arrow 42. The molten material may flow through feeder conduit 18 and gate 20 to enter the shell 40. Upon cooling and solidifying the molten material, the shell and core may be mechanically and/or chemically removed from the molded component. The shell and/or core material(s) may be chemically removed to form a substantially liquefied material capable of being transported through the vent 36 and collected in the substantially circular channel 34. Again, the manifold body 16 may be disassembled from the investment casting mold design 10 and the spent shell and/or core material(s) removed.

The present investment casting mold design facilitates the removal of wax materials and spent shell and core materials without requiring the operator to trim the shell or molded component beyond what is necessary. As a result, less dust enters the mold assembly, fewer part variations occur and a cleaner casting is achieved. The present investment casting mold design also permits the molten metal to be bottom fed into the shell. Molten metal that is bottom fed exhibits improved laminar flow which leads to fewer casting defects. In addition, the bottom feeding process also provides greater protection to fragile ceramic and refractory metal cores. When bottom feeding molten metal into a shell, there is less potential for ceramic and refractory metal cores to break as the molten metal gradually envelopes the cores. In contrast, when pouring molten metal into the shell from above, the molten metal often strikes and breaks the ceramic and refractory metal cores due to the molten metal's weight. Lastly, the dual wall pour cup design also reduces the amount of air, and oxygen that may enter the investment casting mold design which reduces the opportunity to oxidize the core materials. For these reasons, the present investment casting mold design and methods for investment casting using the same provide several advantages over molds and methods of the prior art.

It is to be understood that the invention is not limited to the illustrations described and shown herein, which are deemed to be merely illustrative of the best modes of carrying out the invention, and which are susceptible to modification of form, size, arrangement of parts, and details of operation. The invention rather is intended to encompass all such modifications which are within its spirit and scope as defined by the claims.

What is claimed is:

1. A method for investment casting, comprising:

positioning a base plate relative to a die;

molding a first material between said die and at least a first surface portion of said base plate;

securing one or more patterns to said base plate, said one or more patterns comprising a second material;

applying one or more coating layers over at least portions of said one or more patterns and at least a portion of said first material;

substantially removing said first material through an interior receptacle of a manifold body and said second material through an exterior receptacle of said manifold body to leave one or more shells formed by said coating layers;

removing said base plate;

introducing molten metal to said one or more shells through said interior receptacle of said manifold body;

permitting said molten metal to solidify; and destructively removing one or more investment casting molds.

2. The method of claim 1, wherein substantially removing comprises:

substantially removing said first material through a first feeder conduit and a first aperture in communication with said interior receptacle; and substantially removing said second material through a vent and a substantially circular channel in communication with said exterior receptacle.

3. The method of claim 2, wherein said first material and said second material comprise one or more wax materials.

4. The method of claim 1, wherein introducing comprises introducing said molten metal through said interior receptacle in communication with a first feeder conduit leading to said pattern and exiting through a vent leading from said pattern to said exterior receptacle.

5. The method of claim 1, wherein said manifold body comprises:

a dual wall pour chamber comprising:

said interior receptacle comprising a first substantially conical shaped wall having an interior surface and an exterior surface, said exterior receptacle comprising a second substantially conical shaped wall circumferentially disposed about said interior receptacle and having an interior surface and an exterior surface, wherein said interior surface of said interior receptacle defines in part an aperture, and said exterior surface of said interior receptacle and said interior surface of said exterior receptacle define in part said substantially circular channel.

6. The method of claim 1 used to fabricate a gas turbine engine component.

7. A mold assembly, comprising:

a plurality of mold sections; and a manifold body having a dual wall pour chamber comprising:

said interior receptacle comprising a first substantially conical shaped wall having an interior surface and an exterior surface, said exterior receptacle comprising a second substantially conical shaped wall circumferentially disposed about said interior receptacle and having an interior surface and an exterior surface, wherein said interior surface of said interior receptacle defines in part an aperture, and said exterior surface of said interior receptacle and said interior surface of said exterior receptacle define in part said substantially circular channel;

a plurality of feeder conduits, each extending from said dual wall pour chamber toward an associated one or more of said plurality of mold sections; and a plurality of vents, each extending from said plurality of mold sections toward said dual wall pour chamber.

8. The mold assembly of claim 7, wherein plurality of mold sections comprise three or more mold sections, each mold section associated with a first feeder conduit and a second feeder conduit.

9. The mold assembly of claim 7, wherein each mold section comprises a molding cavity and a gate, said gate extending from a lower end of said molding cavity to an upper end coupled to said feeding conduit.

* * * * *